US005577662A

United States Patent [19]

Hogue et al.

[11] Patent Number: 5,577,662

[45] Date of Patent: Nov. 26, 1996

[54] EMBEDDED RAILWAY TRACK SYSTEM

[76] Inventors: Thomas A. Hogue, 702 Williamsburg, Ennis, Tex. 75119; William K. Hull, 645 Chestnut Ave. #204, Long Beach, Calif. 90802

[21] Appl. No.: 230,393

[22] Filed: Apr. 20, 1994

[51] Int. Cl.[6] ..... E01C 9/04

[52] U.S. Cl. ..... 238/8; 238/9

[58] Field of Search ..... 238/2, 5, 6, 7, 238/8, 9

[56] References Cited

U.S. PATENT DOCUMENTS

| | | | |
|---|---|---|---|
| 1,612,274 | 12/1926 | Fischer | 238/9 |
| 2,950,057 | 8/1960 | Speer | 238/8 |
| 4,093,120 | 6/1978 | Canfield | 238/8 |
| 4,236,670 | 12/1980 | Limmergard | 238/8 |
| 4,368,845 | 1/1983 | Perry et al. | 238/8 |
| 4,415,120 | 11/1983 | Thim | 238/8 |
| 4,461,421 | 7/1984 | Maass | 238/8 |
| 4,606,498 | 8/1986 | Grant et al. | 238/8 |
| 4,793,545 | 12/1988 | Raymond | 238/8 |
| 4,846,401 | 7/1989 | Kennel | 238/7 |
| 4,880,158 | 11/1989 | Cook | 238/8 |
| 4,899,933 | 2/1990 | Martin | 238/8 |
| 5,181,657 | 1/1993 | Davis | 238/8 |
| 5,201,467 | 4/1993 | Kennel et al. | 238/8 |
| 5,282,569 | 2/1994 | Kiyota | 238/2 |

OTHER PUBLICATIONS

Epton Industries, Inc., Literature: *Epflex Railseal Interface,* Apr. 14, 1988.

Bechtel Corp., Drawing: *Modified Embedded Track System For Restraining Rail In U–Wall,* 1992 (est.).

Omni Rubber Products, Inc., Drawing: *Railguard Rubber/ Concrete Grade Crossing System Drawing,* Aug. 21, 1991.

Extrud–A–Rail Inc., p. 31, *Railway Age,* Feb. 1991.

Magnum Manufacturing Corp., Drwings, Date Unknown.

*Primary Examiner*—S. Joseph Morano

*Attorney, Agent, or Firm*—Jenkens & Gilchrist, a Professional Corporation

[57] ABSTRACT

A pair of rails are secured on a plurality of perpendicularly disposed ties which rest on a ballast material. A gauge panel is disposed between the rails and has a top surface which is substantially the same height as the rails. Field inserts are positioned on the outside of the parallel rails and field panels, which have a top surface that is substantially the same height as the rails, are positioned in contact with the field inserts. Gauge inserts are inserted into the space between the gauge panel and the parallel rails.

24 Claims, 5 Drawing Sheets

EMBEDDED RAILWAY TRACK SYSTEM

BACKGROUND OF THE INVENTION

The present invention relates to railway track assemblies and more particularly, to embedded railway track assemblies.

Railway track assemblies typically employ a pair of steel rails supported by a plurality of perpendicularly disposed ties which rest on a ballast material. Often it is desirous to embed the railway tracks so that the top surface of the rails are substantially the same height as the finish grade of the surrounding surface.

When rails are embedded in a surrounding surface, gaps must exist between the rail and the surrounding surface. These gaps permit the wheels of the rail guided vehicle to pass along the rails without obstruction. These gaps also prevent the surrounding surface from contacting the rails, due to construction tolerances or shifting of the surrounding surface area, thereby moving the rails into an unusable out-of-alignment position.

The existence of gaps between a rail and a surrounding surface area causes many problems. One such problem is the possibility of a foreign object becoming wedged in the gap and presenting an obstacle for vehicles traveling along the rail system. Another problem with embedded rail systems is the accumulation and flow of fluids and foreign objects in between the rail and the surrounding surface. These fluids or foreign objects can damage the railway crossing system, such as the ballast, ties, attaching hardware, etc.

For the foregoing reasons, there is a need for embedded railway track systems which prevent foreign objects and/or materials from passing between the rail and the surrounding surface.

SUMMARY

In accordance with the invention, there is provided an elongated gauge side insert for installation between a gauge panel and a rail of a rail crossing system in which the rail is of the kind having a head, a web, and a flange. The insert is formed of resilient material and includes an elongated main body which has a gauge panel side abuttable against a gauge panel. Furthermore, the main body has a top surface offset downwardly (when the main body is installed) from the top of the rail a distance sufficient to accommodate the flange of a wheel on the rail. The main body also has a bottom surface adapted to rest on and be supported by rail anchors associated with the rail flange on the gauge side thereof. The insert also has an elongated leg projecting from the main body toward the rail and abutting the web thereof when installed. The insert further has a resilient arm projecting from the main body toward the rail and upwardly toward the head of the rail, the resilient arm being positioned above the leg, with resilient arm further having the rail end wedged under and against the rail head when installed. Preferably, the main body is further provided with an upright leg upstanding from the main body and abutting the gauge panel when installed. The gauge side insert main body is further provided with a pin cavity extending lengthwise therethrough for accommodating connecting pins for connecting together two or more inserts endwise.

The invention also includes an elongated field side insert for installation between a field panel and a rail of a rail crossing system in which the rail is of the kind having a head, a web, and a flange. The insert includes a head which has a panel side abuttable against the field panel when installed. It has a top surface positioned at substantially the same height as the top of the rail when installed, which provides a uniform rail sealant/filer block between the panels and the rails. The head further has a rail side conforming in profile shape to and abutting against the side of the head and web of the rail when installed. Furthermore, the insert has a lag extending downwardly from the head in position to abut against the web and flange of the rail when installed and the leg has a bottom end abuttable against the rail fasteners associated with the rail when installed. Preferably, the insert is further provided with at least one elasticity cavity extending lengthwise therethrough for imparting a degree of compressibility thereto and the insert is further provided with a pin cavity extending lengthwise therethrough for accommodating connecting pins for connecting together two or more inserts endwise.

BRIEF DESCRIPTION OF THE DRAWINGS

These and other features, aspects, and advantages of the present invention will become better understood with regard to the following description, appended claims, and accompanied drawings where:

DETAILED DESCRIPTION

Figure 1:
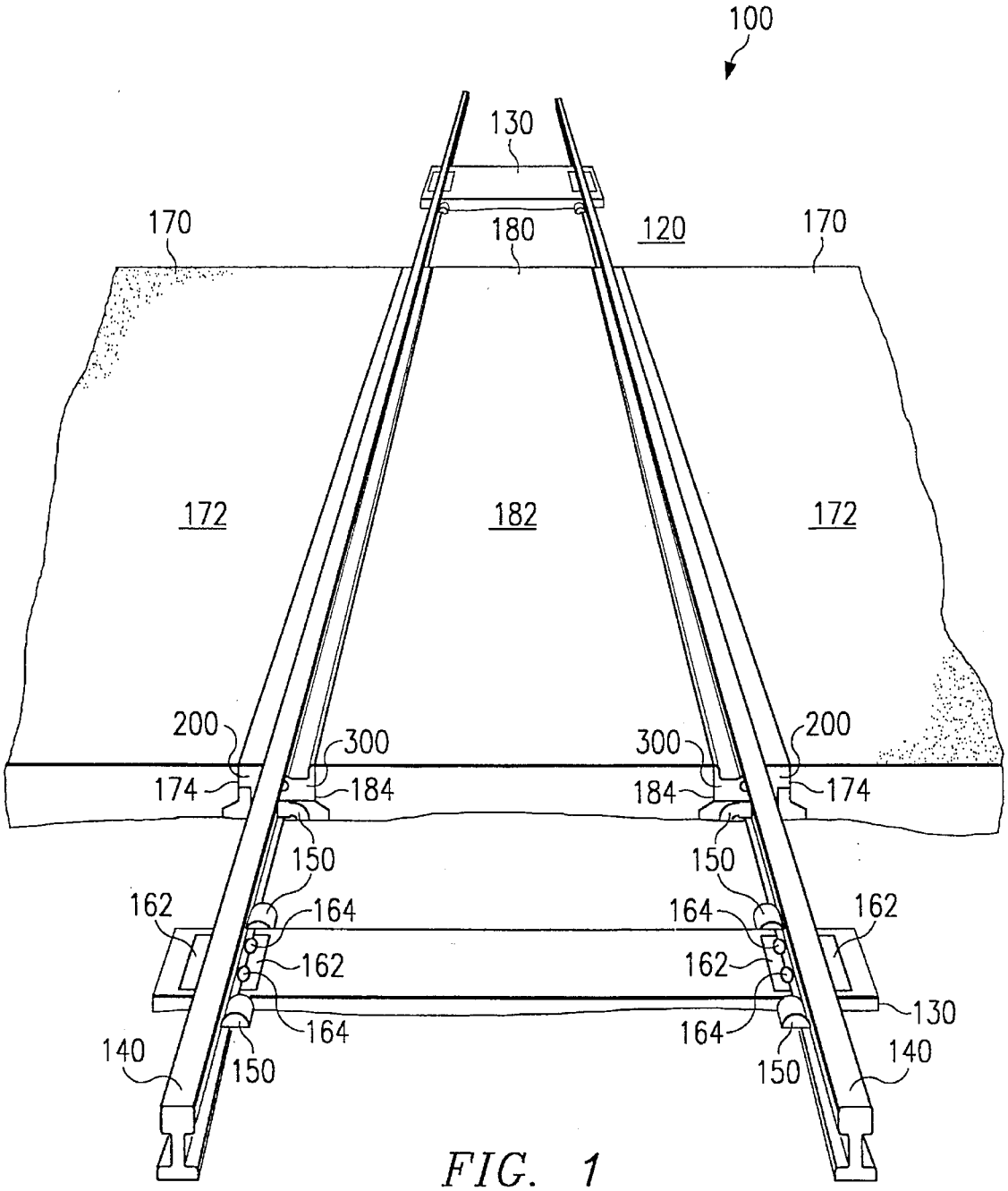
FIG. 1 shows a perspective view, from above, of a railway crossing system in accordance with the present invention.

Referring first to FIG. 1, there is shown a perspective view, from above, of an embedded railway system, generally indicated by 100, in accordance with the present invention. The embedded railway system 100 generally comprises a pair of rails 140 supported on a ballast material 120 by a row of ties 130 which are arranged substantially perpendicular to the rails 140. The ties 130 rest directly on the ballast material 120, and the rails 140 are secured to the ties 130 by hardware which includes a plurality of rail anchors 150, tie plates 162, and rail fasteners 164 such as spikes or clips. Although the embodiment illustrated uses a plurality of rail anchors 150, tie plates 162, and rail fasteners 164 to secure the rails 140 to the ties 130, any fastening hardware can be used which performs the same function of securing the rails 140. The ballast material 120 is a material sufficient for supporting the ties 130, such as gravel, or the like. The ties 130 are constructed of a material strong enough to support the rails 140 and prevent the rails 140 from shifting their position when secured by the rail anchors 150, the tie plates 162, and the rail fasteners 164. Typical materials for the ties 130 include, but are not limited to, wood, concrete, or the like.

Still referring to FIG. 1, it can be seen that the embedded railway system 100 also includes field panels 170, a gauge panel 180, field inserts 200, and gauge inserts 300. The gauge panel 180 is positioned between the rails 140 and has a top surface 182 which is substantially the same height as the rails 140. The field panels 170 are on the outside of the rails 140 and have top surfaces 172 which are substantially the same height as the rails 140. Although the field panels 170 and the gauge panel 180 are described herein as panels, these items can be any material which is used to bring the surface of the area surrounding the rails to approximately the same height as the rails 140. As an example, the field panels 170 and the gauge panel 180 can be constructed of wood, concrete, steel, asphalt, or the like. The field panels 170 have a rail side 174 which face one of the rails 140. Likewise, the gauge panel 180 has rail sides 184 which face the rails 140. The field inserts 200 are elongated members which occupy the space between the rail side 174 of the field panels 170 and the rails 140. Likewise, the gauge inserts 300 are elongated members which occupy the space between the rail sides 184 of the gauge panel 180 and the rails 140. The field inserts 200 and the gauge inserts 300 can be formed of rubber, plastic, felt or the like, but are preferably formed of extruded virgin rubber.

Figure 2:
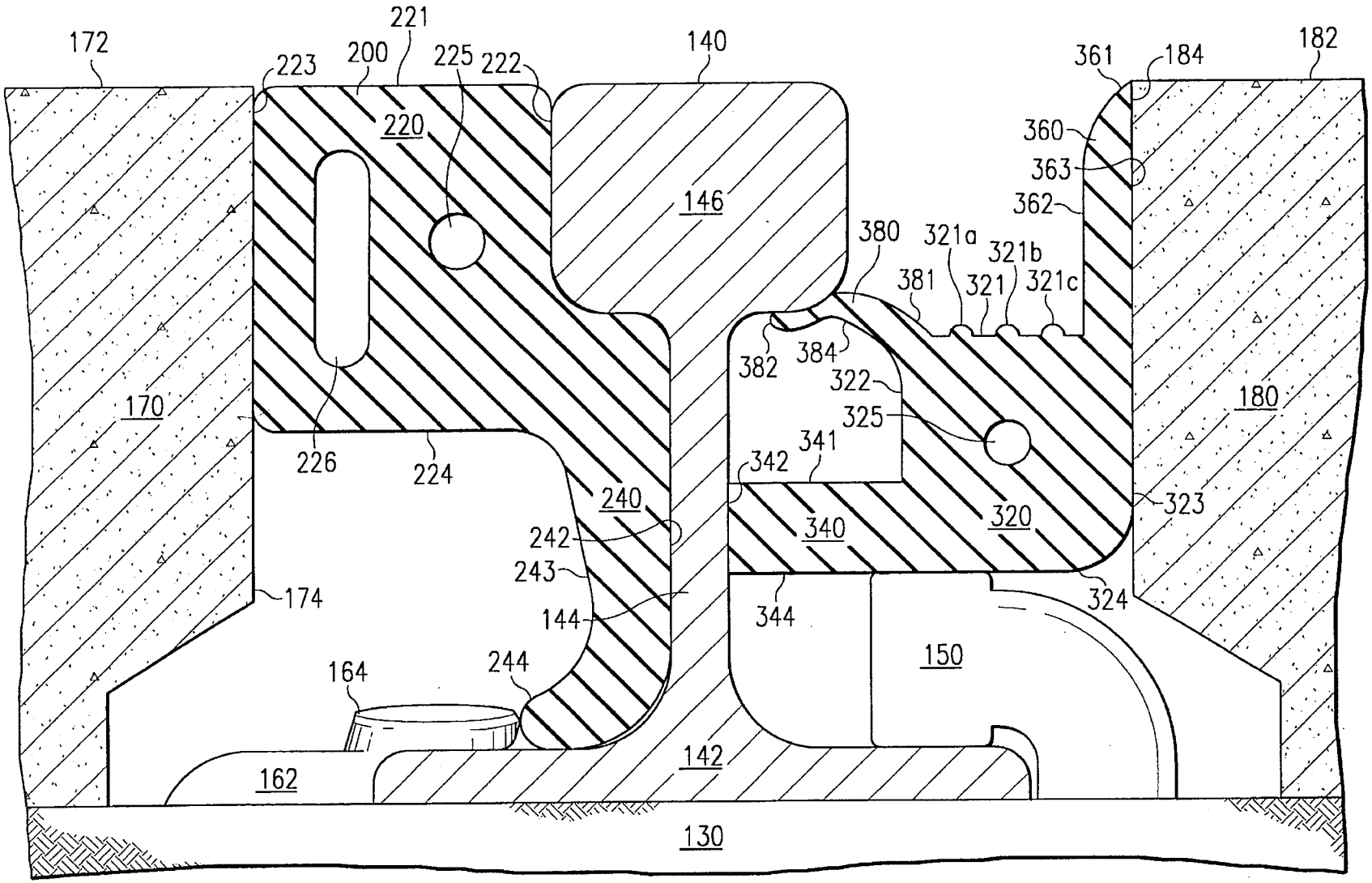
FIG. 2 shows a cross sectional view of a portion around a rail in a system of FIG. 1.

Referring now to FIG. 2, there is shown a cross sectional view of a portion around one of the rails 140 in the embedded railway system of FIG. 1. The rail anchors 150, the tie plates 162, and the rail fasteners 164 secure a rail base 142 of the rail 140 to the ties 130. The rail 140 also has a rail head 146 which is connected to the rail base 142 by a rail web 144. The rail head 146 provides the area of the rail 140 for the wheels of a vehicle traveling on the rails (not shown) to follow.

Still referring to FIG. 2, the field insert 200 is shown in profile and as located between the rail 140 and the rail side 174 of the field panel 170. As shown in FIG. 2, the profile of the field insert 200 comprises a head 220 and a leg 240. The head 220 has a top surface 221 which is positioned at substantially the same height as the rail 140. A rail side 222 of the head 220 contacts the rail 140 and conforms to the rail head 146 and the rail web 144. A panel side 223 of the head 220 engages the rail side 174 of the field panel 170. A bottom surface 224 of the head 220 is positioned sufficiently high that the rail anchors 150, the tie plates 162, and the rail fasteners 164 located below the head 220 will not interfere with the position of the field insert 200. A pin aperture 225 extends longitudinally through the head 220. An elasticity cavity 226 is located in the head 220 near the panel side 223. The elasticity cavity 226 improves the interface of the panel side 223 of the head 220 with the rail side 174 of the field panel 170 by allowing greater compression at the panel side 223 of the head 220.

Referring still to FIG. 2, the leg 240 of the field insert 200 extends in a cantilever arrangement below the head 220. A bottom end 244 of the leg 240 preferably abuts the rail fasteners 164 which secure the rail 140. A rail side 242 of the leg 240 extends from the head 220 of the field insert 200 to the bottom end 244 of the leg 240, and preferably conforms to the rail 140. A panel side 243 of the leg 240 extends from the head 220 of the field insert 200 to the bottom end 244 of the leg 240, and is preferably formed to provide clearance for all of the rail anchors 150, the tie plates 162, and the rail fasteners 164, which secure the rail 140.

Still referring to FIG. 2, the gauge insert 300 is shown in profile and as located between the rail 140 and the rail side 184 of the gauge panel 180. As shown in FIG. 2, the profile of the gauge insert 300 comprises a main body 320, a leg 340, an upright arm 360, and a resilient arm 380. The main body 320 is positioned with a top surface 321 located below the rail head 146. The top surface 321 has top surface ribs 321*a*, 321*b*, and 321*c* which face upward. Although the top surface 321 is illustrated in the preferred embodiment with top surface ribs 321*a–c*, any feature could be used in place of the top surface ribs 321*a–c* which would visually identify the top surface 321, such as grooves, markings, or the like. A rail side 322 of the main body 320 is formed to leave a space between the rail web 144 and the main body 320. A bottom surface 324 of the main body 320 is preferably adapted to rest against the rail anchors 150 which are secured to the base 142 of the rail 140. A panel side 323 of the main body 320 is positioned against the rail side 184 of the gauge panel 180. A pin aperture 325 extends longitudinally through the main body 320.

Referring still to FIG. 2, the leg 340 of the gauge insert 300 extends in a cantilever arrangement from the rail side 322 of the main body 320. A rail end 342 of the leg 340 contacts the rail web 144 of the rail 140. A top side 341 of the leg 340 extends from the main body 320 of the gauge insert 300 to the rail end 342 of the leg 340, and preferably leaves a space between the leg 340 and the rail head 146. A bottom side 344 of the leg 340 extends from the main body 320 of the gauge insert 300 to the rail end 342 of the leg 340. The bottom side 344 of the leg 340 is preferably parallel with the bottom surface 324 of the main body 320.

Still referring to FIG. 2, the upright arm 360 extends upwardly from the main body 320 of the gauge insert 300. A top end 361 of the upright arm 360 extends to approximately the same height as the top surface 182 of the gauge panel 180. A rail side 362 of the upright arm 360 extends from the main body 320 of the gauge insert 300 to the top end 361 of the upright arm 360, and preferably provides a space between the upright arm 360 and the rail 140. A panel side 363 of the upright arm 360 extends from the main body 320 of the gauge insert 300 to the top end 361 of the upright arm 360, and preferably contacts the rail side 184 of the gauge panel 180.

Referring still to FIG. 2, the resilient arm 380 extends in a cantilever arrangement upwardly from the main body 320 and in the same direction as the leg 340. A rail end 382 of the resilient arm 380 is adapted for contacting, and conforming with, a lower portion of the rail head 146. A top surface 381 of the resilient arm 380 extends from the main body 320 of the gauge insert 300 to the rail end 382 of the resilient arm 380. A bottom surface 384 of the resilient arm 380 extends from the main body 320 of the gauge insert 300 to the rail end 382 of the resilient arm 380, and preferably provides a space between the bottom surface 384 of the resilient arm 380 and the top side 341 of the leg 340.

Figure 3:
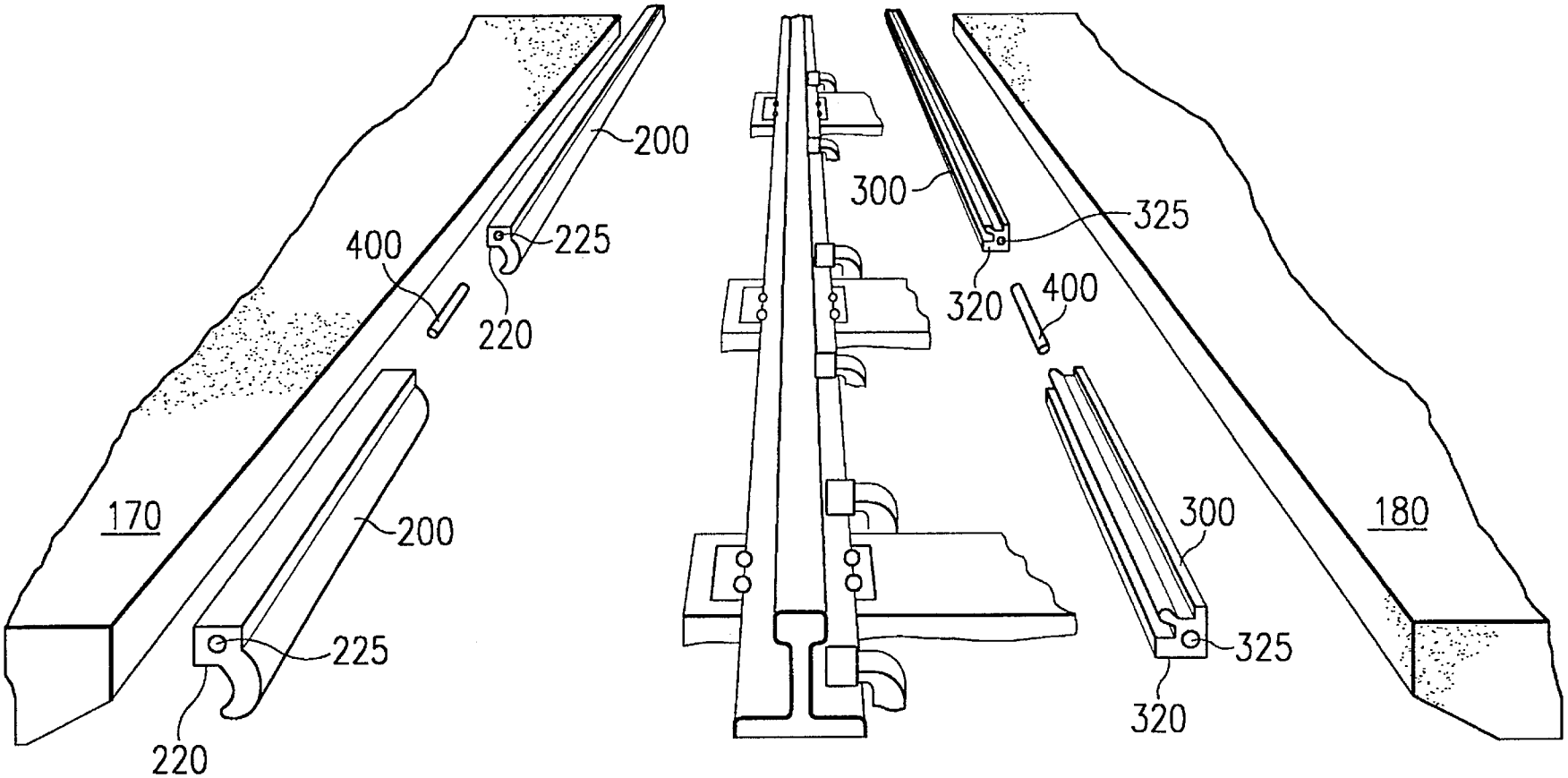
FIG. 3 shows a partial, exploded, perspective view of the railway crossing system in FIG. 1.

Referring now to FIG. 3, there is shown a partial exploded perspective view of the railway crossing system in FIG. 1. It can be seen that two or more sections of the field inserts 200, and the gauge inserts 300, can be joined by pins 400 to fill the gaps between the field panels 170 and the rails 140, and the gaps between the rails 140 and the gauge panel 180. One of the pins 400 is inserted into the pin aperture 225 of two sections of the field insert 200 at the intersection of the two sections. Likewise, one of the pins 400 is inserted into the pin aperture 325 of the gauge insert main body of two sections of the gauge insert 300. The pin aperture 225 of the field insert 200, and the pin aperture 325 of the gauge insert 300, are adapted to grip the pins 400. The pins 400 can be steel pins, or the like, such as reinforcing bar. In this manner, separate sections of the field insert 200, or the gauge insert 300, which are joined together will and act as one continuous section and resist separation or gapping at each end joint. Although the pin aperture 225 and the pin aperture 325 are illustrated in the preferred embodiment as extending longitudinally through the entire length of the field insert 200 and the gauge insert 300, respectively, for the present invention, the pin aperture 225 and the pin aperture 325 only need to extend into the field insert 200 and the gauge insert 300, respectively, a sufficient length to secure the pins 400. In one embodiment, the pins 400 are concrete reinforcing bars.

Figure 4:
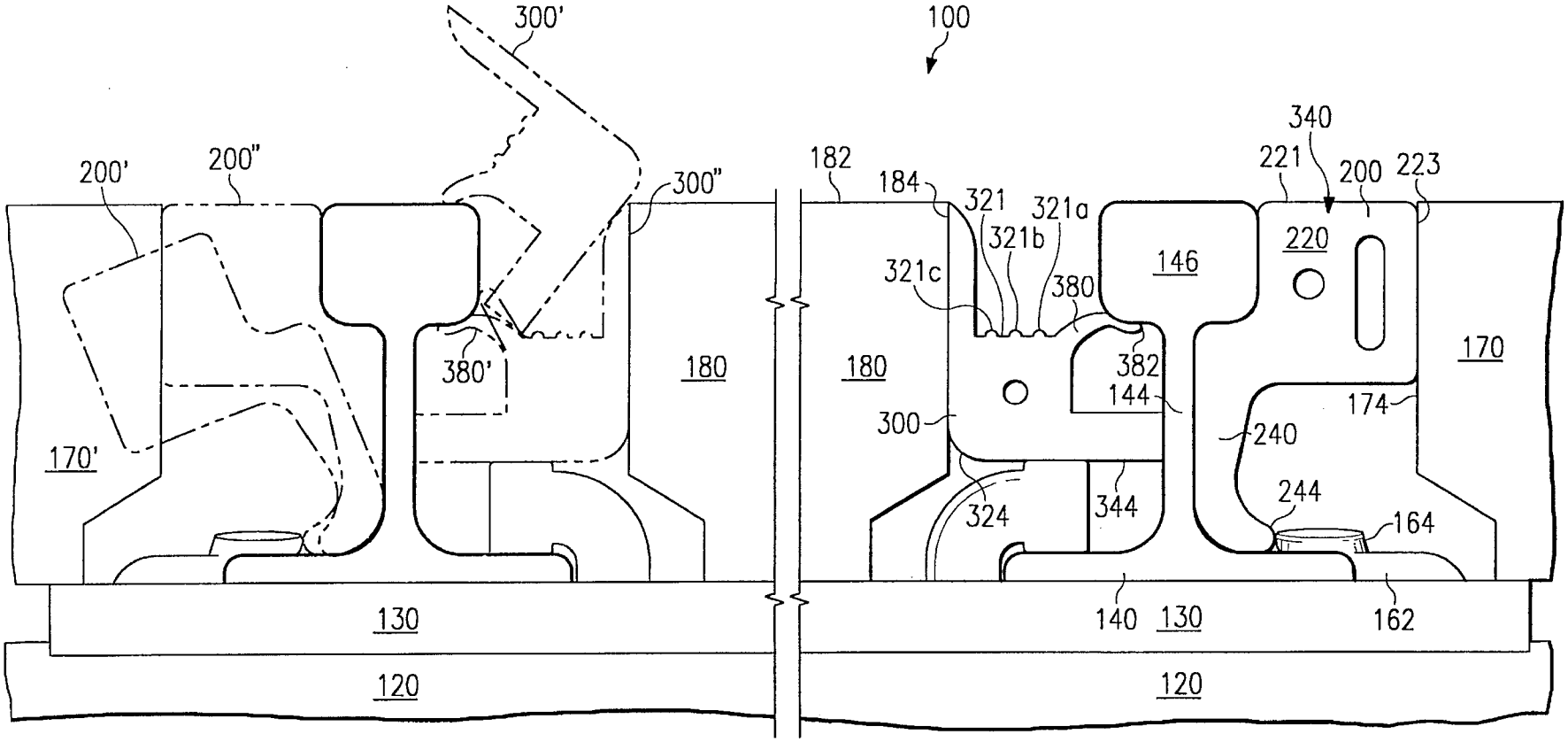
FIG. 4 shows a cross sectional view of the embedded railway system of FIG. 1, illustrating the assembly of that system.

Referring now to FIG. 4, there is shown a cross sectional view of the embedded railway system 100 in FIG. 1, illustrating the assembly of the embedded railway system 100. The ballast material 120 is graded to a uniform level, and the ties 130 are spaced apart thereon. The rails 140 are positioned parallel to each other and perpendicular to the ties 130. The rail anchors 150, the tie plates 162, and the rail fasteners 164 secure the rails 140 to the ties 130. After the rails 140 are secured to the ties 130, the gauge panel 180 is positioned in between the rails 140.

Still referring to FIG. 4, the gauge insert 300 is located in a position 300' with the leg 340 between the rail 140 and the rail side 184 of the gauge panel 180. The gauge insert 300 is rotated and then pressed downward into a position 300". In the position 300" of the gauge insert 300, the main body 320 of the gauge insert 300 is below the top surface 182 of the gauge panel 180, and the top surface ribs 321*a–c* of the main body 320 face upward. Preferably, the bottom surface 324 of the main body 320 rests against the rail anchors 150 in the position 300". After the gauge insert 300 is pushed downward into the position 300", the resilient arm 380 is pushed toward the rail web 144 until the rail end 382 of the resilient arm 380 is moved into a position 380' with the rail end 382 of the resilient arm 380 contacting the lower surface of the rail head 146. The same procedure is repeated for both gauge sides of the embedded railway system 100.

Still referring to FIG. 4, the field insert 200 is positioned against the rail 140 with the bottom end 244 of the leg 240 between the rail fastener 164 and the rail 140. The field insert 200 is then pivoted about the bottom end 244 of the leg 240 from a position 200' to a position 200" where the top surface 221 is at substantially the same height as the rail head 146. After the field insert 200 is rotated to the position 200", the field panel 170 is located in a position 170' with the rail side 174 of the field panel 170 contacting the panel side 223 of the head 220 of the field insert 200. The same procedure is repeated for both field sides of the embedded railway system 100.

Figure 5:
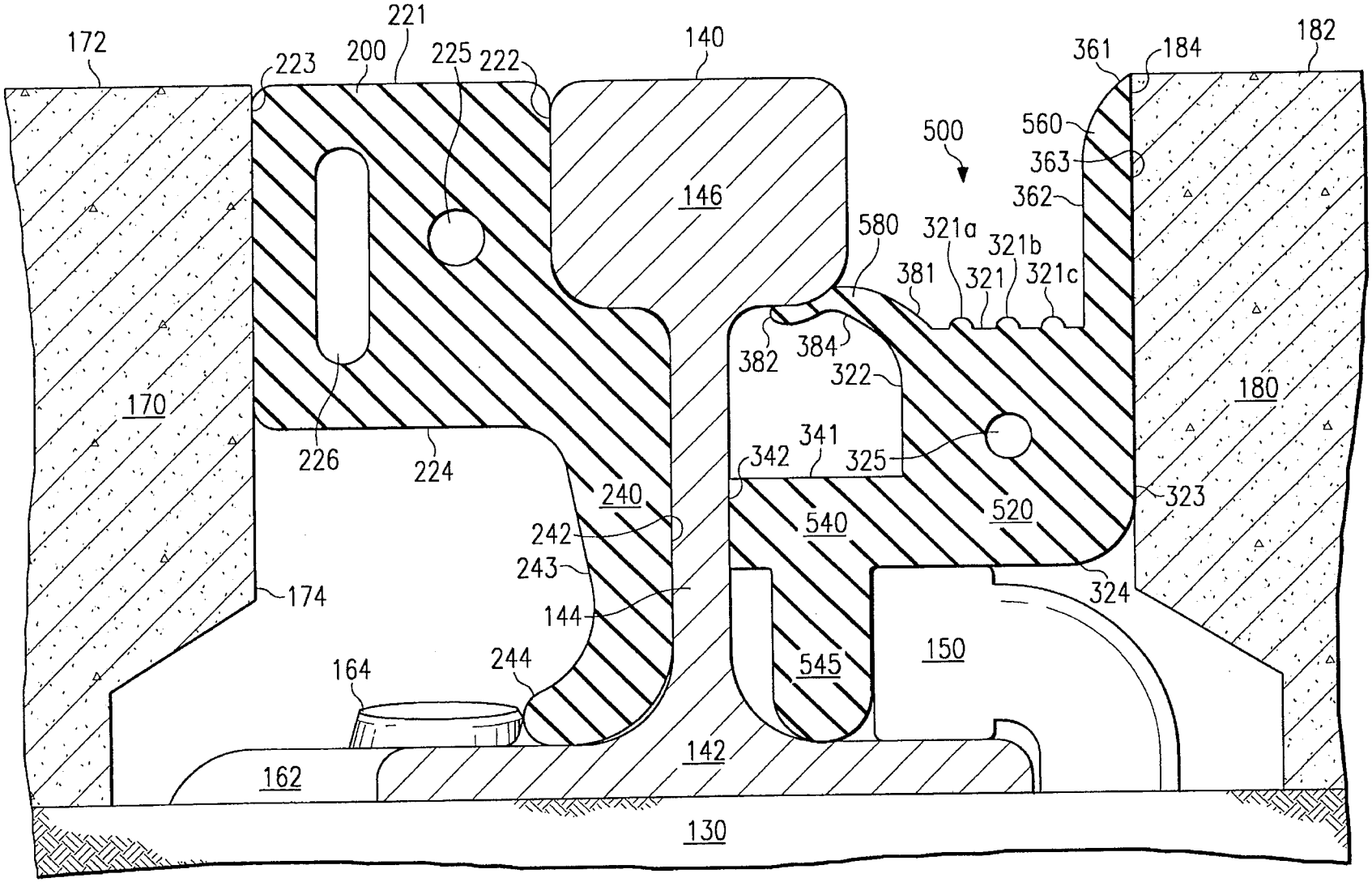
FIG. 5 shows a partial cross sectional view of an alternate embodiment a gauge insert of the present invention.

Referring now to FIG. 5, there is shown a partial cross sectional view of an alternate embodiment of the gauge insert of the present invention, indicated generally at 500. Similar to the gauge insert 300 in FIG. 1, the gauge insert 500 has a main body 520, a leg 540, an upright arm 560, and a resilient arm 580. The main body 520, the leg 540, the upright arm 560, and the resilient arm 580 have the same features and functions as the main body 320, the leg 340, the upright arm 360, and the resilient arm 380, respectively, of the gauge insert 300 in FIG. 2. However, the leg 540 also includes a lobe 545 extending below the leg 540. It is preferred that the lobe 545 extend below the leg 540 with sufficient length to rest on the rail base 142 of the rail 140, or abut against the rail anchor 150, or both. In this manner, the leg 545 will support the gauge insert 500, or prevent the gauge insert 500 rotating, or both.

Referring now to FIGS. 1–5, it can be seen that the top of the rail head 146 is substantially the same height as the top surface 182 of the gauge panel 180 and the top surface 172 of the field panels 170. The substantially uniform height of the rails 140, the gauge panel 180, and the field panels 170 provide an embedded railway system 100 which allows vehicles travelling on the rails 140 to pass without obstruction, and allows vehicles crossing the rails to pass with a minimum of obstruction due to the rails 140 themselves. The field inserts 200 present a uniform rail sealant/filler block between the field panels 170 and the rails 140, but allow variances in the distance between the field panels 170 and the rails 140 due to construction tolerances, shifting components, etc. The gauge inserts 300 and 500 reduce the accumulation and passage of fluids and other foreign objects in the space between the gauge panel 180 and the rails 140, and allows the retaining flange of the wheels (not shown) for a vehicle travelling on the rails 140 to pass without obstruction due to the lowered position of the top surface 321 of the main body 320, 520. The gauge inserts 300, 500 also allow variances in the distance between the gauge panel 180 and the rails 140 due to construction tolerances, shifting components, etc. Furthermore, the top surface ribs 321*a–c* of the main body 320, 520 provide a visual indication that the gauge insert as installed in the correct orientation.

It is thus believed that the operation and construction of the present invention will be apparent from the foregoing description of a preferred embodiment. While the method and apparatus shown or described as being characterized as being preferred, it will be obvious to a person of ordinary skill in the art that various changes and modifications may be made therein without departing from the spirit and scope of the invention as defined in the following claims.

What is claimed is:

1. A rail crossing seal system comprising an elongated insert installed between a panel and a rail, said rail being of the kind having a head, a web, and a base, said elongated insert being formed of resilient material and having a profile comprising:

a main body having a panel side abuttable against said panel;

said main body having a top surface offset downwardly when said main body is installed from the top of said rail a distance sufficient to accommodate the flange of a wheel on said rail;

a cantilevered leg projecting outwardly from said main body toward said rail and abutting the web thereof when installed; and a cantilevered resilient arm projecting upwardly and outwardly from said main body toward said rail and upwardly toward the head of said rail, said resilient arm being positioned above said leg, said resilient arm further having a rail end wedged under and against said rail head when installed.

2. A rail crossing seal system as in claim 1, wherein the profile of said elongated insert further includes an upright leg upstanding from a top surface of said main body and butting said panel when installed adjacent to said panel side of said main body.

3. A rail crossing seal system as in claim 1, wherein a bottom surface of said main body is adapted to rest on and be supported by rail anchors.

4. A rail crossing seal system as in claim 1, wherein said cantilevered leg further includes a lobe adapted for resting on and being supported by said rail.

5. A rail crossing seal system as in claim 1, wherein said top surface of said main body further includes means for visually identifying said top surface.

6. A rail crossing seal system as in claim 1, wherein said main body further includes a pin cavity extending lengthwise therein for accommodating a connecting pin for connecting together multiple ones of said insert endwise.

7. A rail crossing seal system comprising an elongated insert installed between a panel and a rail, said rail being of the kind having a head, a web, and a base, said elongated insert being formed of resilient material and having a profile comprising:

a head having a panel side adapted for abutting against said panel when installed, and having a top surface positioned at substantially the same height as the top of said rail when installed;

said head further having a rail side conforming in profile shape to, and adapted for, abutting against the side of the head and web of said rail when installed;

a cantilevered leg extending downwardly from said head in position to abut against the web and base of said rail when installed; and said leg having a bottom end adapted for abutting against rail fasteners associated with said rail when installed.

8. A rail crossing seal system as in claim 7, wherein said insert is further provided with at least one elasticity cavity extending lengthwise therein for imparting a degree of compressibility thereto.

9. A rail crossing seal system as in claim 7, wherein said insert further includes a pin cavity extending lengthwise therein for accommodating a connecting pin for connecting together multiple one of said insert endwise.

10. An embedded railway track assembly comprising:

a pair of rails parallely aligned on ties and provided with rail fasteners, each of said rails having a head connected to a base by a web;

a gauge panel positioned between said rails;

field panels positioned outside of and along said parallel rails;

an elongated gauge insert for each of said rails, said elongated gauge inserts being installed between said gauge panel and one of rails, and each of said elongated gauge inserts having a profile comprising:

a main body having a gauge panel side abutting against said gauge panel, a top surface being offset downwardly from a top of said rail a distance sufficient to accommodate a flange of a wheel on said rail;

a cantilevered gauge leg projecting from said main body toward said rail and abutting the web thereof; and a resilient cantilevered arm projecting from said main body toward said rail and upwardly toward the head of said rail, said resilient cantilevered arm being positioned above said cantilevered gauge leg, said resilient cantilevered arm further having a rail end abutting against said rail head; and an elongated field insert for each of said rails, said elongated field inserts being installed between one of said field panels and one of said rails, and each of said elongated field inserts having a profile comprising:

an insert head having a panel side abutting against said field panel, a top surface positioned at substantially the same height as a top of said rail, and a rail side conforming in profile shape to and abutting against the head of said rail; and a cantilevered field leg extending downwardly from said insert head, said cantilevered field leg abutting against the web and the base of said rail and having a bottom end abutting against the rail fasteners.

11. A rail crossing seal system comprising an elongated member installed between a rail and a surrounding surface, said elongated member having a profile comprising:

a main body having a top surface, a surface side, and a bottom surface;

a cantilevered leg extending from the rail side of said main body, said leg having a rail end, a bottom side extending from the rail end to said main body, and a top side extending from the rail end to said main body; and a cantilevered resilient arm extending upwardly from said main body and in the same direction as said cantilevered leg, said resilient arm having a rail end, a top surface extending from the rail end to said main body, and a bottom surface extending from the rail end to said main body.

12. A rail crossing seal system as in claim 11, wherein the rail end of said cantilevered resilient arm is formed to conform with a surface of a head on said rail.

13. A rail crossing seal system as in claim 11, wherein the top surface of said main body is formed to be positioned below a rail head of said rail.

14. A rail crossing seal system as in claim 11, wherein the top surface of said main body further includes means for visually identifying the top surface of said main body.

15. A rail crossing seal system as in claim 11, wherein said cantilevered leg further includes a lobe extending below the bottom side of said cantilevered leg.

16. A rail crossing seal system as in claim 11, wherein the bottom side of said cantilevered leg is substantially coplanar with the bottom surface of said main body.

17. A rail crossing seal system as in claim 11, wherein said main body includes a pin aperture extending longitudinally therein for accommodating a connecting pin for connecting together multiple ones of said elongated member endwise.

18. A rail crossing seal system as in claim 11, wherein the profile of said elongated member further comprises an upright arm extending upwardly from said main body, said upright arm having an upper end and a surface interface side extending downwardly from said upper end to said main body.

19. A rail crossing seal system as in claim 18, wherein the surface interface side of said upright arm is formed to be substantially coplanar with the surface side of said main body.

20. A rail crossing seal system comprising an elongated member installed between a rail and a surrounding surface, said elongated member having a profile comprising:

a head having a top surface, a surface interface side, and a bottom surface; and a cantilevered leg extending from said head and abutting a rail web, said cantilevered leg having a bottom surface parallel with the bottom surface of said head, said cantilevered leg having a projection extending from said bottom surface of said leg and abutting a rail base.

21. A rail crossing seal system as in claim 20, wherein said head has an elasticity cavity formed near the surface interface side.

22. A rail crossing seal system as in claim 20, wherein the projection of said leg is formed to abut with a rail fastener.

23. A rail crossing seal system as in claim 20, wherein said head includes a pin aperture extending longitudinally therein for accommodating a connecting pin for connecting together multiple ones of said elongated member endwise.

24. An embedded railway assembly comprising:

a ballast material;

a plurality of ties located on said ballast material and positioned parallel to each other;

a pair of rails extending parallel to each other and located on said plurality of ties, each of said rails having a head connected to a base by a web;

means for securing said base of said rails to said ties and said ballast;

a gauge panel located between said rails, said gauge panel having a top surface at substantially the same height as said rails and a rail side facing said rails;

a gauge insert having a main body which rests on said means for securing and contacts the rail side of said surrounding surface, a cantilevered gauge leg which extends from the main body and contacts said rail, and a cantilevered resilient arm which contacts a lower portion of the head of said rail;

a field panel positioned on the outside of said pair of rails, said field panel having a top surface at substantially the same height as the surrounding surface and a rail side facing said rail; and a field insert having a head and a field leg extending below the head, the head of said field insert having a top surface at substantially the same height as said rail and said field panel, a rail side which contacts said rail, and a panel side which contacts the rail side of said field panel, and the field leg of said field insert having a rail side which contacts said rail and a bottom end which contacts said rail and said means for securing.

* * * * *

Disclaimer 5,577,662 — Thomas A. Hogue, Ennis, TX; William K. Hull, Long Beach, CA. EMBEDDED RAILWAY TRACK SYSTEM. Patent dated November 26, 1996. Disclaimer filed November 29, 1999, by the assignee, RFR Industries, Inc.

Hereby enters this disclaimer to claims 7, 8, 9, 20, 21, 22, and 23 of said patent.

*(Official Gazette,* April 18, 2000)